US010847931B1

(12) United States Patent
Peng et al.

(10) Patent No.: US 10,847,931 B1
(45) Date of Patent: Nov. 24, 2020

(54) CABLE CONNECTION STRUCTURE

(71) Applicant: Shenzhen chuet Electronic Technology Co., Ltd., Shenzhen (CN)

(72) Inventors: Sen Peng, Guangdong (CN); Hongchuan Wang, Guangdong (CN)

(73) Assignee: Shenzhen chuet Electronic Technology Co., Ltd., Shenzhen (CN)

( * ) Notice: Subject to any disclaimer, the term of this patent is extended or adjusted under 35 U.S.C. 154(b) by 0 days.

(21) Appl. No.: 16/572,590

(22) Filed: Sep. 16, 2019

(30) Foreign Application Priority Data

Jul. 22, 2019 (CN) ..... 2019 2 1147939 U

(51) Int. Cl.
*H01R 13/627* (2006.01)

(52) U.S. Cl.
CPC ..... *H01R 13/6277* (2013.01)

(58) Field of Classification Search
CPC ..... H01R 13/6277
USPC ..... 439/350
See application file for complete search history.

(56) References Cited

U.S. PATENT DOCUMENTS 4,619,496 A * 10/1986 Forney, Jr. ..... H01R 24/40 439/434
5,195,904 A * 3/1993 Cyvoct ..... H01R 13/6277 439/349
5,938,465 A * 8/1999 Fox, Sr. ..... H01R 13/627 439/350
6,227,895 B1 * 5/2001 McFarlane ..... H01R 13/6277 439/352
6,398,574 B1 * 6/2002 Biermann ..... H01R 13/6277 439/350
6,439,925 B1 * 8/2002 Lin ..... H01R 13/6277 439/350
7,351,088 B1 * 4/2008 Qu ..... H01R 13/5219 439/352
2004/0137777 A1 * 7/2004 Fukuda ..... H01R 13/5219 439/349
2014/0306520 A1 * 10/2014 Oe ..... H01R 13/6275 307/9.1
2018/0123288 A1 * 5/2018 Shao ..... H01R 9/0521
2018/0138633 A1 * 5/2018 DeWitt ..... H01R 13/6277
2019/0190187 A1 * 6/2019 Fukazawa ..... H01R 13/6277
2020/0044387 A1 * 2/2020 Chiang ..... H01R 13/6277

* cited by examiner

*Primary Examiner* — Gary F Paumen

(57) ABSTRACT

A cable connection structure, including a male connector and a female connector, further including a snapping groove provided on a sidewall of the male connector, a depth of the snapping groove is extended in parallel to a central axis of the male connector; a snapping portion protrudes from an inner sidewall of the snapping groove; and the inserted member protrudes from a sidewall of the female connector, and the inserted member is linearly movable along a radial direction of the female connector under an external force. When the male connector is connected to the female connector, the inserted member can be inserted into the snapping groove and form a snap fit with the snapping portion to prevent the male connector and the female connector from losing connection. The application ensures the stable connection between the male connector and the female connector.

6 Claims, 2 Drawing Sheets

CABLE CONNECTION STRUCTURE

TECHNICAL FIELD

The application relates to the technical field of electrical connectors, in particular to a cable connection structure.

BACKGROUND

In the use of electrical equipment, in order to achieve the length increase of the cable or the signal transmission between the devices, the male connector and the female connector are often used for connection. However, the traction force is too small when the male connector and the female connector are used for connection, and the cable is vulnerable to external force, resulting in the male connector comes out of the female connector to lose the connection. At present, the general scheme on the market adopts a locking structure (such as a bolt and a nut) to fix the male connector and the female connector. However, in the case where the external traction suddenly becomes large, the locking structure is easy to cause that a difficult separation between the male connector and the female connector, which leads to cable breakage, or equipment damage, high maintenance costs, and even casualties.

SUMMARY OF THE APPLICATION

As above, a connector having both a certain locking strength and an external traction overload protection is necessary. The present application provides a cable connection structure, which can achieve a locking force in actual need by adjusting the elastic strength. The locking force ensures that the connection is reliable during normal operation and protects the connection in the event of a pulling.

The application is realized as follows:

A cable connection structure, including a male connector and a female connector are cooperated with each other to achieve an electrical connection, and further including: a snapping groove, provided on a sidewall of the male connector, wherein a depth direction of the snapping groove is parallel to a central axis of the male connector; a snapping portion, protruding from an inner sidewall of the snapping groove; an inserted member, protruding from a sidewall of the female connector, and the inserted member is, linearly movable along a radial direction of the female connector under an external force; when the male connector and the female connector are connected, the inserted member is able to be inserted into the snapping groove and form a snap fit with the snapping portion to prevent the male connector and the female connector from disconnecting.

Further, in a preferred embodiment of the present application, the snapping groove is an annular groove, and the snapping groove is disposed along a circumferential direction of the sidewall of the male connector; the inserted member is disposed on an inner sidewall of the female connector along a circumferential direction of the female connector.

Further, in a preferred embodiment of the present application, the inner sidewall of the female connector is provided with a receiving groove, the receiving groove is disposed along a circumferential direction of the female connector; the inserted member is an annular structure and is disposed in the receiving groove.

Further, in a preferred embodiment of the present application, a thickness of a sidewall of the female connector is equal to a distance from the snapping portion to another inner sidewall of the snapping groove.

Further, in a preferred embodiment of the present application, an outer diameter of a sidewall of the female connector is equal to an inner diameter of the sidewall of the male connector.

Further, in a preferred embodiment of the present application, the snapping portion is provided with a guiding portion, wherein the guiding portion is configured to guide the inserted member to be inserted into the snapping groove.

Further, in a preferred embodiment of the present application, the inserted member is made of a rubber or a metal material.

Further, in a preferred embodiment of the present application, the inserted member is a circlip having an opening.

The advantageous effects of the present application is as following: by obtaining the cable connection structure according to the above design, when the male connector and the female connector are connected, the inserted member can be easily inserted into the snapping groove and form a snap fit with the snapping portion. And the inserted member and the snapping portion cooperate to provide a resistance to prevent separation of the male connector and the female connector to ensure the connection strength between the male connector and the female connector. Moreover, since the inserted member is able to move linearly along the radial direction of the female connector under an external force, when the external force is sufficiently large, the inserted member can be linearly moved by the external force to lose the snap fit from the snapping portion, so that the male connector and the female connector are disconnected to avoid cable damage, equipment damage and even casualties caused by excessive traction and difficult cable separation, which prolongs the service life of the cable and reduces maintenance costs, and protect the property and personnel safety.

BRIEF DESCRIPTION OF THE DRAWINGS

In order to more clearly illustrate the technical solutions of the embodiments of the present application, the drawings used in the embodiments will be briefly described below. It should be understood that the following drawings illustrate only certain embodiments of the present application. Therefore, it should not be seen as limiting the scope, and those skilled in the art can obtain other related drawings according to the drawings without any creative work.

Figure 1:
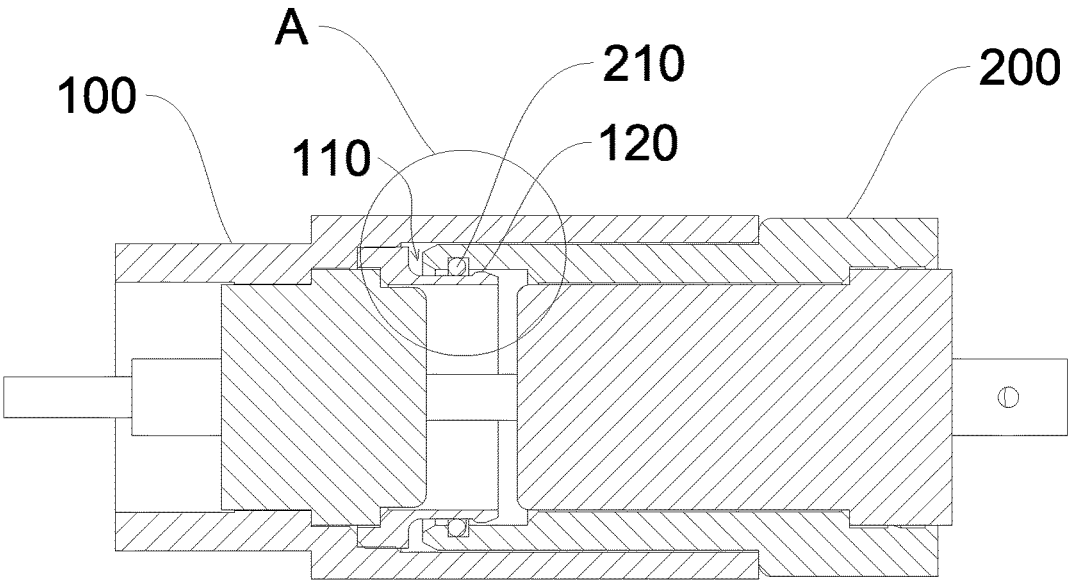
FIG. 1 is a schematic structural view of a cable connecting structure of the present application.

In drawings: a male connector 100, a female connector 200, a snapping groove 110, a snapping portion 120, a inserted member 210, a receiving groove 220, and a guiding portion 121.

DETAILED DESCRIPTION OF THE EMBODIMENTS

In order to make the objects, technical solutions and advantages of the embodiments of the present application clearer, the technical solutions in the embodiments of the present application will be clearly and completely described in conjunction with the drawings in the embodiments of the present application. It is apparent that the embodiments described are part of the embodiments of the present application, not all of them. Based on the embodiments of the present application, all other embodiments obtained by those skilled in the art without creative efforts are within the scope of the present application. Therefore, the following detailed descriptions of the embodiments of the present application are not intended to limit the scope of the claimed application, which are merely shown part of embodiments of the present application. Based on the embodiments of the present application, all other embodiments obtained by those skilled in the art without creative efforts are within the scope of the present application.

In the description of the present application, it should be understood that the terms "center", "longitudinal", "lateral", "length", "width", "thickness", "upper", "lower", "front", "back", "left", "right", "vertical", "horizontal", "top", "bottom", "inside", "outside", "clockwise", "counterclockwise" and etc., and the other terms indicating position or relationship is based on the orientation or positional relationship of the drawings shown, which is merely for the convenience of describing the present application, not indicating or implying that the device or component referred to has a specific orientation, is constructed or operated in a specific orientation, thereby it should not to be construed as limiting the present application.

In addition, the terms "first" and "second" are used for descriptive purposes only and are not to be construed as indicating or implying a relative importance or implicitly indicating the number of technical features indicated. Thus, features defining "first"; and "second" may include one or more of the features either explicitly or implicitly. In the description of the present application, the meaning of "a plurality" is two or more unless specifically defined otherwise.

In the present application, the terms "installation", "connected with", "connected to", "fixed" and the like shall be understood broadly, for example, it may be fixed or detachable connection, or integrated for one; may be mechanical or electrical connection; may be directly connected, or indirectly connected through an intermediate medium, or it may be the internal communication of two components or the interaction of two components, unless otherwise explicitly defined and limitation. For those skilled in the art, the specific meanings of the above terms in the present application can be understood on a case-by-case basis.

Figure 2:
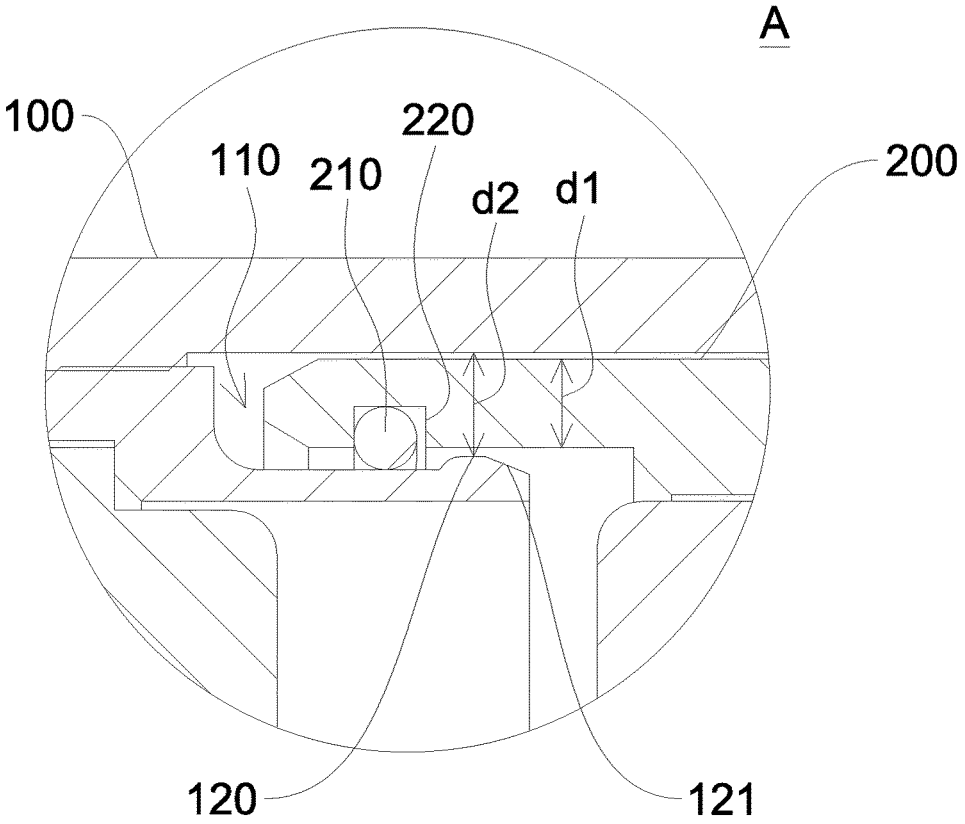
FIG. 2 is a partial enlarged view of the portion A in FIG. 1.
Figure 3:
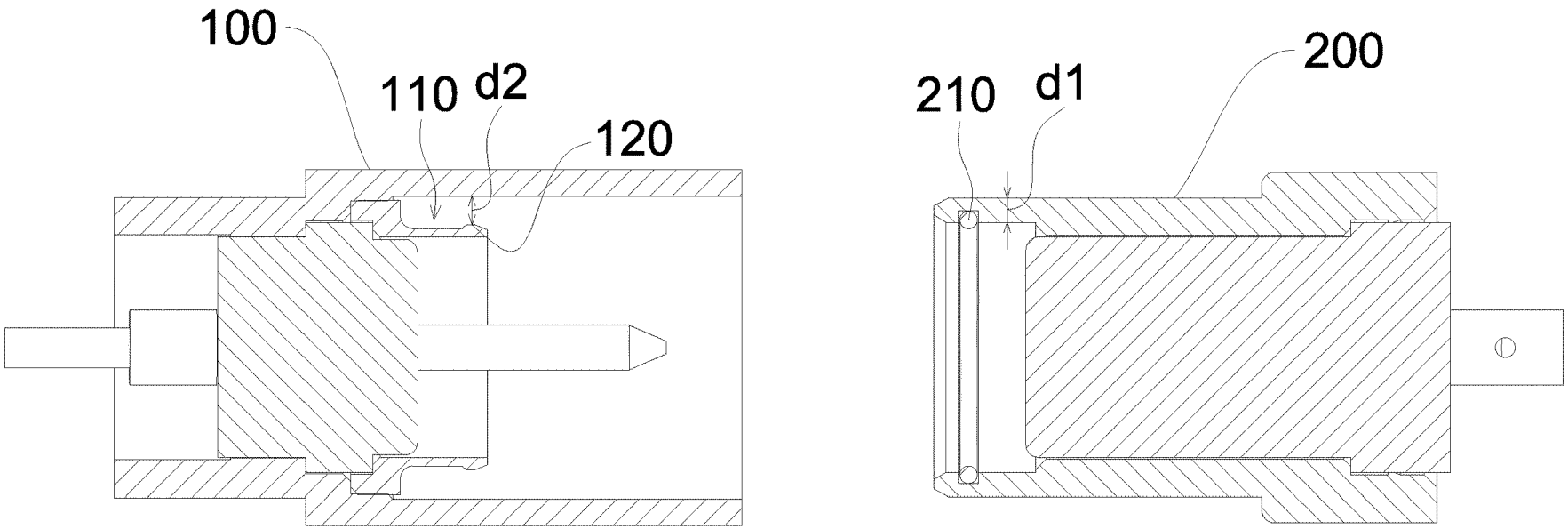
FIG. 3 is a schematic structural view of the male connector and the female connector of the cable connecting structure in a separated state according to the present application.

Please refer to FIGS. 1 to 3, the embodiment of the present application is to provide a cable connection structure. The cable connection structure includes a male connector 100 and a female connector 200 that can match with each other to achieve electrical connection. In use, the male connector 100 can be inserted into the female connector 200 to realize the connection of the two cables.

The sidewall of the male connector 100 is provided with a snapping groove 110, and a depth direction of the snapping groove 110 is parallel to the central axis of the male connector 100. A snapping portion 120 is disposed on an inner sidewall of the snapping groove 110, and the snapping portion 120 protrudes from a surface of the inner sidewall of the snapping groove 110. Wherein, the cross-sectional shape of the snapping portion 120 protruding from the inner sidewall of the snapping groove 110 may be a square, a rectangle, a triangle, an arc, or the like. Preferably, the cross-sectional shape of the snapping portion 120 is an arc shape. An inserted member 210 is protruded from a sidewall of the female connector 200, and the inserted member 210 is linearly movable along a radial direction of the female connector 200 by an external force.

When the male connector 100 and the female connector 200 are connected, the inserted member 210 can be inserted into the snapping groove 110, and the inserted member 210 can form a snap fit with the snapping portion 120, to provide the resistance for preventing the male connector 100 and the female connector 200 from disconnecting, thereby preventing the male connector 100 and the female connector 200 from disconnecting under the action of a small external force, which will cause a unstable cable connection.

The inserted member is linearly movable along the radial direction of the female connector 200 under an external force, so that the inserted member 210 can be linearly moved along the radial direction of the female connector 200 when the external force is large, so as to form an avoidance, and the inserted member 210 and the snapping portion are out from snapping connection. So that the male connector 100 can be disengaged from the female connector 200 to avoid cable breakage damage caused by hard disconnection of the male connector 100 and the female connector 200 under the large external force, which prolongs the service life of the cable and reduces maintenance costs.

It should be understood that the inserted member 210 and the snapping portion 120 cooperate with each other to achieve the engagement, so the inserted member 210 and the snapping portion 120 should be oppositely disposed, for example, when the inserted member 210 is disposed on the inner sidewall of the female connector 200, the snapping portion 120 should be disposed on the inner sidewall of the snapping groove 110 near the central axis of the male connector 100, or when the inserted member 210 is disposed on the outer sidewall of the female connector 200, the snapping portion 120 should be disposed in the inner sidewall of the snapping groove 110 away from the central axis of the male connector 100, and so on.

And when the male connector 100 and the female connector 200 are separated by an external force, the inserted member 210 can move in a direction away from the snapping portion 120 under a certain external force to form an avoidance, so that the inserted member 210 can be disengaged from the snapping groove 110, thereby separating the male connector 100 and the female connector 200.

According to the above embodiment, when the inserted member 210 is inserted into the snapping groove 110 to form a snap fit, the providing of the inserted member 210 and the snapping portion 120 ensures a stable connection between the male connector 100 and the female connector 200, to make the two difficult to separate. When the male connector 100 and the female connector 200 are subjected to an certain external force, the inserted member 210 can be formed an avoidance to out from the snapping groove 110, resulting in the separation of the male connector 100 and the female connector 200, which prevents the male connector 100 and the female connector 200 from being subjected a large external force, so that the cable breakage damage can be avoided.

It should be noted that the snapping groove 110 and the snapping portion 120 can also be disposed inside the female connector 200, so the inserted member 210 can be correspondingly disposed on the male connector 100. The above embodiments can also achieve the advantageous effects to be achieved by the present application, and details are not described herein for brevity.

In an exemplary embodiment of the present application, the snapping groove 110 is an annular groove, and the snapping groove 110 is disposed along a circumferential direction of a sidewall of the male connector 100. Correspondingly, the inserted member 210 is disposed on the inner sidewall of the female connector 200 along the circumferential direction of the female connector 200. Therefore, when the male connector 100 and the female connector 200 are connected, it is not necessary to consider the corresponding positions of the inserted member 210 and the snapping groove 110, only requires to insert the male connector 100 into the female connector 200, i.e., the insertion of the inserted member 210 into the snapping groove 110 is achieved, facilitating the connection of the male connector 100 and the female connector 200.

The inserted member 210 is circumferentially disposed on the inner sidewall of the female connector 200 to ensure the snap fit of the inserted member 210 with the snapping portion 120, that is, as long as the inserted member 210 is inserted into the snapping groove 110, no matter where the snapping portion is disposed on the inner sidewall of the snapping groove 110, the snap fit with the inserted member 210 can be realized, so as to avoid the disconnection of the male connector 100 and the female connector 200 caused by the dislocation of the inserted member 210 and the snapping portion 120.

In an exemplary embodiment of the present application, the snapping portion 120 is disposed on the inner sidewall of the snapping groove 110 along the circumferential direction of the male connector 100 to avoid the relative shaking between the inserted member 210 and the snapping portion 120 when the two are in contact with each other, thereby ensuring stable contact between the inserted member 210 and the snapping portion 120. So that the damage of the male connector 100 and the female connector 200 caused by the relative shaking between the inserted member 210 and the snapping portion 120 is prevented, which prolongs the service life of the cable.

In an exemplary embodiment of the present application, when the inserted member 210 is disposed on the inner sidewall of the female connector 200, the inner sidewall of the female connector 200 is provided with a receiving groove 220. The depth direction of the receiving groove 220 is parallel to the radial direction of the female connector 200, and the receiving groove 220 is disposed along the circumferential direction of the female connector 200. The inserted member 210 is an annular structure and is disposed in the receiving groove 220. Wherein, the inserted member 210 may be made of a rubber or a metal material (for example, stainless steel, iron, copper, etc.) to improve the durability of the inserted member 210.

It should be understood that the outer diameter of the inserted member 210 is larger than the inner diameter of the sidewall of the female connector 200 to prevent the inserted member 210 from coming out of the receiving groove 220. The inner diameter of the inserted member 210 is smaller than the outer diameter of the sidewall of the female connector 200, so that the inserted member 210 protrudes from the inner sidewall of the female connector 200, and can form a snap fit with the snapping portion 120.

In an exemplary embodiment of the present application, the inserted member 210 is a circlip having an opening. The circlip having the opening can be deformed under the action of an external force to enlarge the inner diameter of the circlip to form an avoidance. And by setting the material and size of the inserted member 210, that is, the force required to generate the deformation of the inserted member 210 can be adjusted to meet the requirements of different force levels, so that the application range of the connection structure is expanded.

In an exemplary embodiment of the present application, the sidewall thickness d1 of the female connector 200 is substantially equal to the distance d2 between the snapping portion 120 and the other inner sidewall of the snapping groove 110, as shown in FIG. 2. When the inserted member 210 is inserted into the snapping groove 110, the snapping portion 120 can abut the sidewall of the female connector 200, so that the outer sidewall of the female connector 200 can be attached the other sidewall of the snapping groove 110, thereby the sidewall of the female connector 200 can be in surface contact with the inner sidewall of the snapping groove 110, and the connection between the female connector 200 and the male connector 100 is more stable, avoiding the occurrence of shaking when the female connector 200 and the male connector 100 are connected.

In an exemplary embodiment of the present application, an outer diameter of a sidewall of the female connector 200 is equal to an inner diameter of a sidewall of the male connector 100, that is, the inner sidewall of the snapping groove 110 away from the central axis of the male connector 100 coincides with the surface of the inner sidewall of the male connector 100, and the outer sidewall of the female connector 200 can be in contact with the inner sidewall of the male connector 100 when the inserted member 210 is inserted into the snapping groove 110, to enlarge the contact area of the sidewall between the female connector 200 and the male connector 100. The stability of the connection of the female connector 200 and the male connector 100 is further ensured.

In an exemplary embodiment of the present application, the snapping portion 120 is provided with a guiding portion 121 for guiding the inserted member 210 to be inserted into the snapping groove 110. Specifically, the guiding portion 121 is an inclined surface disposed on the snapping portion 120, and the inclined surface is disposed at a notch of the snapping groove 110 and inclined toward the snapping groove 110. When the male connector 100 and the female connector 200 are connected, the inserted member 210 is in contact with the guiding portion 121, and the guiding portion 121 can guide the inserted member 210 to facilitate the insertion of the inserted member 210, and the guiding portion 121 can apply a force to the inserted member 210 to cause movement to form an avoidance, so that the inserted member is inserted into the snapping groove 110.

The above description is only a preferred embodiment of the present application, and is not intended to limit the present application, and various modifications and changes can be made by those skilled in the art. Any modifications, equivalent substitutions, improvements, etc. made within the spirit and scope of the present application are intended to be included within the scope of the present application.

What is claimed is:

1. A cable connection structure, comprising a male connector and a female connector matched with each other to achieve an electrical connection, and further comprising:

a snapping groove, provided on a sidewall of the male connector, wherein a depth direction of the snapping groove is parallel to a central axis of the male connector;

a snapping portion, protruding from an inner sidewall of the snapping groove;

an inserted member, protruding from a sidewall of the female connector, and the inserted member is linearly movable along a radial direction of the female connector under an external force;

when the male connector and the female connector are connected, the inserted member is able to be inserted into the snapping groove and form a snap fit with the snapping portion to prevent the male connector and the female connector from disconnecting;

the snapping groove is an annular groove, and the snapping groove is disposed along a circumferential direction of the sidewall of the male connector; the inserted member is disposed on an inner sidewall of the female connector along a circumferential direction of the female connector;

a thickness of the sidewall of the female connector is substantially equal to a distance from the snapping portion to another inner sidewall of the snapping groove.

2. The cable connection structure according to claim 1, wherein the inner sidewall of the female connector is provided with a receiving groove, the receiving groove is disposed along a circumferential direction of the female connector; the inserted member is an annular structure and is disposed in the receiving groove.

3. The cable connection structure according to claim 1, wherein an outer diameter of the sidewall of the female connector is equal to an inner diameter of the sidewall of the male connector.

4. The cable connection structure according to claim 1, wherein the snapping portion is provided with a guiding portion, wherein the guiding portion is configured to guide the inserted member to be inserted into the snapping groove.

5. The cable connection structure according to claim 1, wherein the inserted member is made of a rubber or a metal material.

6. The cable connection structure according to claim 2, wherein the inserted member is a circlip having an opening.

* * * * *